United States Patent [19]

Kerr

[11] Patent Number: 4,597,270

[45] Date of Patent: Jul. 1, 1986

[54] AUTOMATIC ICE-MAKING SYSTEM

[75] Inventor: William T. Kerr, Lamont, Fla.

[73] Assignee: Maximma Consumer Technologies, Inc., Tallahassee, Fla.

[21] Appl. No.: 665,544

[22] Filed: Oct. 25, 1984

[51] Int. Cl.[4] ..... F25C 1/00

[52] U.S. Cl. ..... 62/138; 62/340; 339/154 A

[58] Field of Search ..... 62/340, 138; 417/313, 417/572; 137/565; 339/154 A

[56] References Cited

U.S. PATENT DOCUMENTS

| | | | |
|---|---|---|---|
| 2,613,506 | 10/1952 | Cook | 62/138 |
| 3,796,063 | 3/1974 | Wulke et al. | 62/340 |
| 3,983,583 | 10/1976 | Herman et al. | 62/340 X |
| 4,027,499 | 6/1977 | Barto et al. | 62/340 |
| 4,073,159 | 2/1978 | Trippi et al. | 62/340 |

*Primary Examiner*—William E. Tapolcai

*Attorney, Agent, or Firm*—Duckworth, Allen, Dyer & Pettis

[57] ABSTRACT

An automatic ice-making system for use with a bottled water supply includes a refrigeration unit having a freezer section for receiving and freezing water. An enclosed reservoir for bottled water is provided with the refrigeration unit, a feed line being established between the reservoir and the freezer section. A valve is interposed in the feed line for controlling the flow of water through the feed line between the reservoir and the freezer. A pump is provided with the reservoir for pumping water through the feed line. A specific electrical contact configuration provides means for simultaneously energizing the pump and commencing the opening of the valve, responsive to a sensed condition in the freezer. The preferred configuration of the reservoir is a flat, generally U-shaped container, with the pump being positioned within an enclosure located within the confines of the U-shaped container.

7 Claims, 4 Drawing Figures

AUTOMATIC ICE-MAKING SYSTEM

BACKGROUND OF THE INVENTION

1. Field of the Invention

The present invention relates generally to automatic ice-making equipment for refrigerators and the like, and particularly relates to such systems which are available for use with bottled water.

2. Description of the Prior Art

It is well known in the prior art to provide means for automatically feeding water into the freezer section of a refrigerator, in order to make ice.

An example of one such arrangement is disclosed by Gottschalk in U.S. Pat. No. 2,921,447. As there disclosed, the ice-making apparatus of Gottschalk's invention contemplates a plurality of tubes in which ice is formed.

In U.S. Pat. No. 2,771,749, Miller discloses an improved cube-freezing and automatic dispensing assembly of durable construction which can be economically produced with a minimum number of working parts.

Harbison et al. in U.S. Pat. No. 3,226,939 disclose a freezer compartment arranged to support an ice storage receptacle so as to position a flexible ice tray to cause ice pieces to be harvested and discharged into the receptacle In U.S. Pat. No. 3,163,025, Dahlgren discloses an automatic ice-making system discribed to be an improvement over the Harle U.S. Pat. No. 3,089,312. Harle disclosed an ice-maker providing means for manually harvesting ice pieces without completely removing the freezer tray or mold from the refrigerator and for automatically refilling the freezer tray with water following a harvesting operation. The patent to Dahlgren had as its purpose an improvement over the Harle technique, and particularly relating to improved means for controlling the supply of the water to the freezer tray. This is accomplished by supplying water to the freezer tray only when the tray is in its normal freezing position and empty.

Linstromberg, et al. in U.S. Pat. No. 3,775,994 disclose a "refrigerator or the like with externally mounted water valve." In the construction taught by Linstromberg et al., the water flow control valve is disposed exteriorly of the refrigerator cabinet adjacent the ice-maker mechanism. In one example, the patentees teach that the valve means may comprise a solenoid-operated valve and that the means for connecting the valve to the support may include a quick disconnect, both for the electrical connections of the solenoid to the electrical control and for the fluid flow connections from the valve to the duct leading to the automatic ice-maker.

SUMMARY OF THE INVENTION

The present invention is directed to an automatic ice-making system for use with a bottled water supply. In accordance with the preferred embodiment of this invention, the system includes a refrigeration unit having a freezer section for receiving and freezing water. The system is further provided with an enclosed reservoir for bottled water adjacent to the refrigeration unit, with a feed line for water between the reservoir and the freezer section of the refrigerator unit. A valve is interposed in the feed line for controlling the flow of water through the feed line between the enclosed reservoir and the feed section. A pump is provided adjacent to the refrigeration unit and with the reservoir for pumping water out of the reservoir and through the feed line.

In the preferred embodiment of the present invention, means are provided in the freezer section for sensing the level of water therein and providing an output indicating a demand for additional water, with means responsive to that output for energizing the pump and only operating the pump during periods in which the valve is energized.

The reservoir may comprise a generally U-shaped, flat container having a top feed opening for bottled water. Within the space of the U-shaped container, a small enclosure is provided for the pump. The pump has a feed line extending through its own enclosure and thence through the top of the container to the bottom thereof in order to permit water to be readily pumped through the valve after both the pump and the valve have been energized, as described above.

Other novel features of the present invention are discussed below with reference to the drawings.

DETAILED DESCRIPTION OF THE PREFERRED EMBODIMENT

A preferred embodiment of the present invention will now be described with reference to the drawings.

Figure 1:
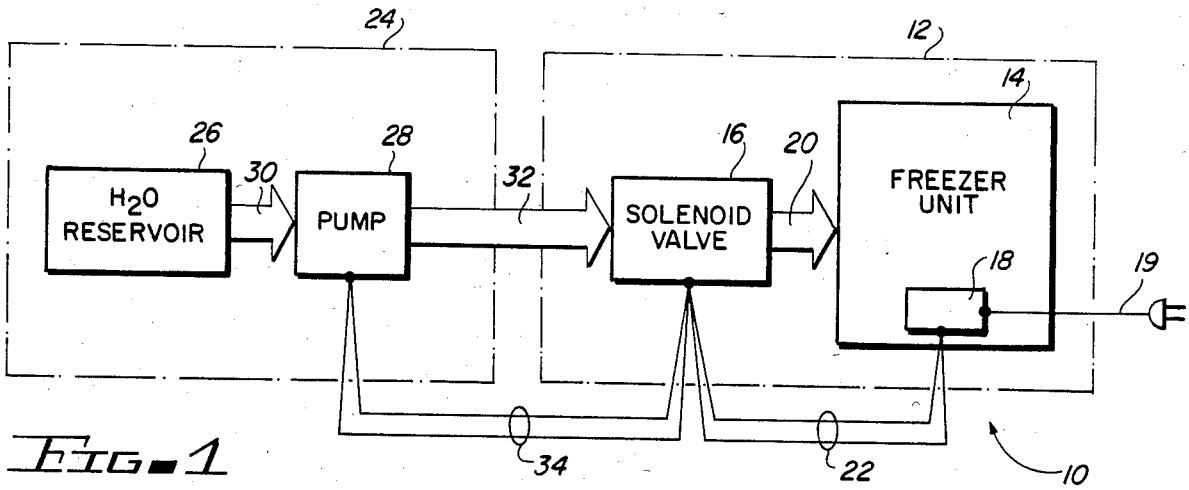
FIG. 1 is a block diagram illustrating the system of the present invention.

In FIG. 1, the system 10 of the present invention is shown in block diagram form. The system is adapted for use with a conventional refrigerator, referred to in the block diagram as element 12, which typically includes an automatic freezer unit 14. A solenoid valve 16 is provided with the system 10, usually within the refrigerator 12 and is coupled to the freezer unit 14 via a conventional water hose 20. Located within the freezer unit 14 is a sensor element 18 adapted to detect a condition which would permit the water to flow into the freezer unit 14 via the solenoid valve 16 and the water hose 20. The sensor unit 18 is adapted to turn the solenoid valve 16 on via circuit line pair 22, and is provided with an alternating current supply through circuit line 19.

In accordance with the present invention, a bottled water supply unit 24 is provided and is adapted to be positioned adjacent the refrigerator 12, as for example on the top thereof. The unit 24 includes a bottled water reservoir 26 and a pump 28, with a water line 30 therebetween. The pump 28 in turn is coupled through the solenoid valve 16 by a water line 32. The pump 28 is electrically coupled to the solenoid valve 16 by circuit wire pair 34. The structural features of the electrical connection between the pump 28 and the valve 16 is described in greater detail below with reference to FIG. 4.

Figure 2:
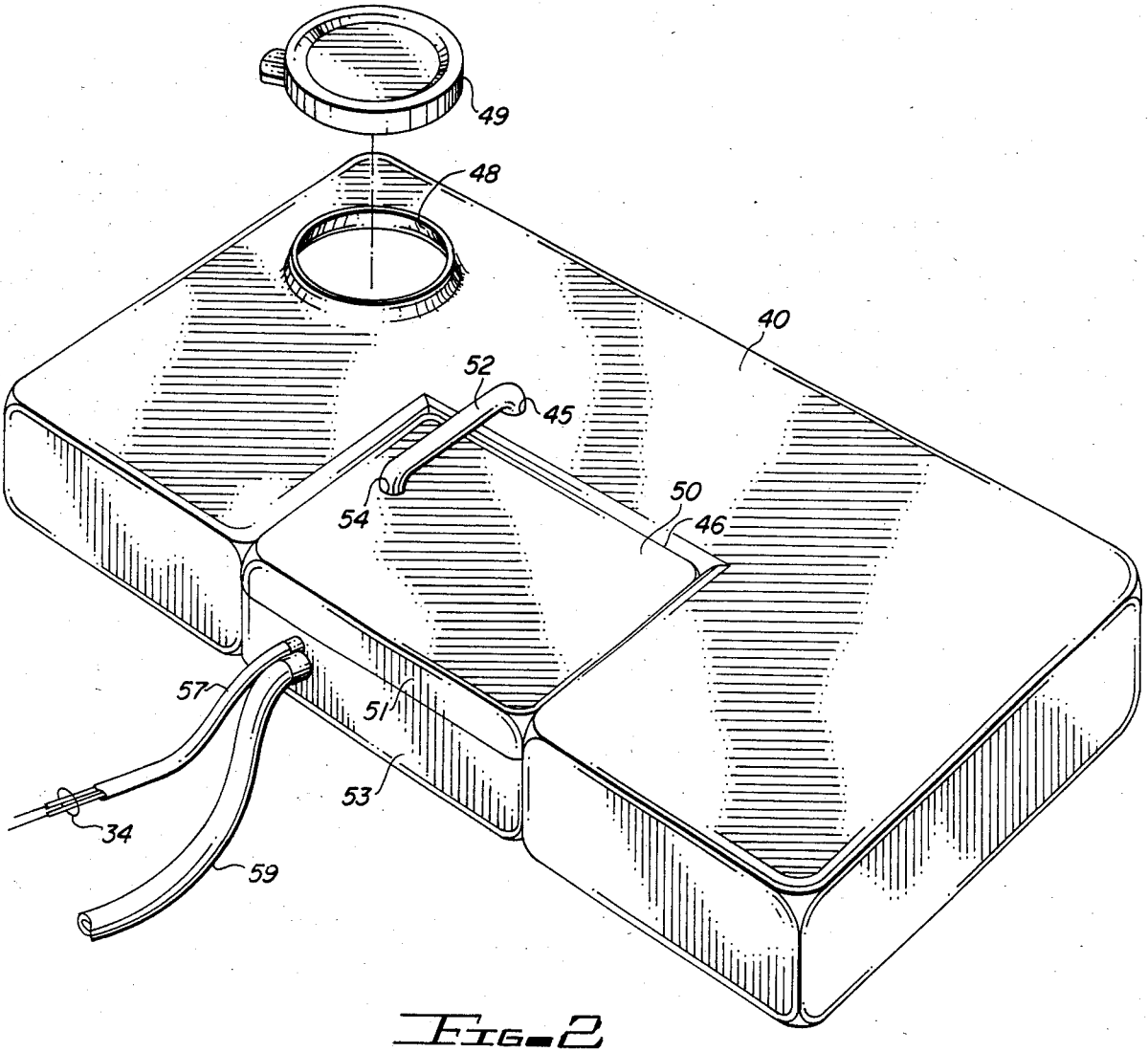
FIG. 2 is a perspective view illustrating the reservoir-pump combination of the present invention.
Figure 3:
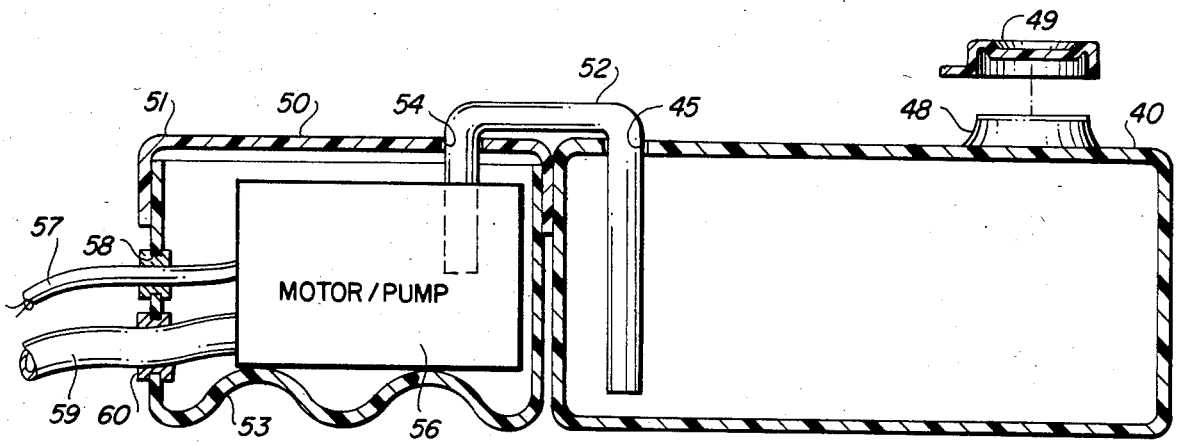
FIG. 3 is a cross-section of a portion of FIG. 2.

The specific construction of the bottled water supply unit 24 of the present invention is shown in FIGS. 2 and 3. Preferably, the bottled water reservoir 26 comprises a plastic container 40. As shown in FIG. 2, the container 40 has a generally U-shaped configuration defining an indentation 46 (note FIG. 2). The container 40 is provided with a filler opening defined by a lip 48, and is further provided with a closure 49.

The bottled water reservoir construction of FIGS. 2 and 3 permits the pump enclosure 50 to be snugly fitted within the U-shaped indentation 46, thus permitting the surrounding cool water within the container 40 to function as a heat sink for the pump 56 within the housing 50. The housing 50 may be formed of a bottom 53 and complimentary top 51. The pump 56 is connected to the water in the container 40 through a plastic tube 52 which extends through a hole 54 in the top 51 and thence through a hole 45 in the top of container 40.

As is shown in FIG. 2, the two wire pair 34 (also note FIG. 1) is coupled to the pump 56 via insulated circuit line 57 extending through an aperture 58 in the side of the pump housing bottom 53. Likewise, the water line 32 of FIG. 1 is comprised of a hose 59 extending through a second aperture 60 in a side wall of the pump housing bottom 53 (FIG. 2).

Figure 4:
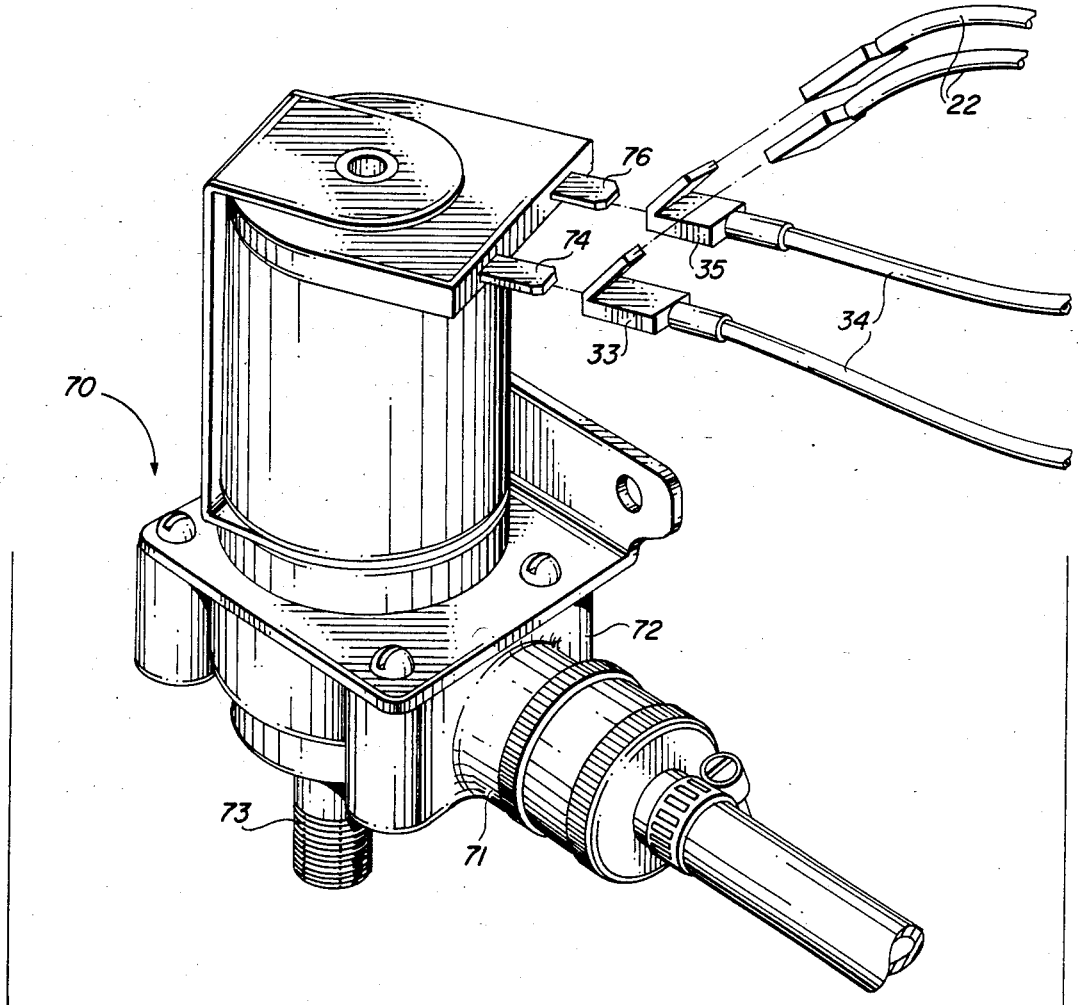
FIG. 4 is a perspective view illustrating a control valve for the system depicted in FIG. 1.

Construction details of the solenoid valve (element 16 in FIG. 1) is shown in FIG. 4. The specific structure of the solenoid valve, referred to generally by reference numeral 70, includes a solenoid valve body 72 of a generally conventional construction, with an input water opening 71 and an output opening 73. The pump 34 and valve 70 are energized from the sensing element 18 within the freezer unit 14, via the prongs of a pair of circuit terminals 74 and 76. Circuit pair 34 from the pump 56 is provided with "piggyback" prongs 33 and 35, to which circuit pair 22 is connected. Thus, when the solenoid 70 is actuated from circuit lines 22 across terminal prongs 74 and 76, there is simultaneous actuation of the pump 56 (element 28 in FIG. 1) via the circuit wire pair 34.

It will thus be appreciated that the automatic ice-making system for use with bottled water as shown in FIGS. 1–4 and described above provides a relatively simple and fascile construction. It will also be understood that the sensing unit 18 of the freezer 14 provides an output indicating a demand for additional water to the automatic freezer unit, and in the configuration shown above further provides a means responsive to that sensed condition for energizing the pump 56. Further in accordance with the present invention, that sensed condition provides means for simultaneously energizing the pump and commencing the opening of the valve. It will be further understood that the sensing element 18 further provides means for terminating the output (i.e. the a.c. current) to the valve 70 and the pump 56 when the demand for water in the automatic freezer unit 14 is met; that is, there is a simultaneous deenergizing of the pump and a closing of the valve upon the termination of the output from the sensing element 18 when the water requirements in the automatic freezer unit 14 are fulfilled.

I claim:

1. An automatic ice-making system for use with a bottled water supply comprising:

(a) a refrigeration unit including a freezer section for receiving and freezing water, said freezer section including a sensor element for providing an output indicating a demand for additional water;

(b) an enclosed reservoir for bottled water adjacent to said refrigeration unit, said reservoir comprising a generally flat container having a U-shaped indentation therein;

(c) a pump positioned within said U-shaped indentation and having a feed line formed of a relatively rigid tube extending into the bottom of said container and in communication with said pump;

(d) a solenoid valve having an input coupled to a water output of said pump and having an output coupled to said freezer section of said refrigeration unit;

(e) a first circuit wire pair coupled between said pump and said solenoid valve, said first circuit wire pair including piggyback prong connectors at the juncture with said valve;

(f) a second circuit wire pair coupled between said sensor element in said freezer section and said piggyback connectors of said first circuit pair and wherein (g) the sensing of a demand for additional water by said sensing element permits the simultaneous energizing of said pump and the opening of said valve, to permit water to be pumped from said container into said freezer unit.

2. The automatic ice-making system recited in claim 1 wherein said sensor element further comprises means for terminating said output when said demand for water in said freezer section is met.

3. The automatic ice-making system recited in claim 2, further comprising means for simultaneously de-energizing said pump and closing said valve upon termination of said output.

4. The automatic ice-making system recited in claim 3 wherein said pump is interposed in said feed line between said reservoir and said valve.

5. The automatic ice-making system recited in claim 4 wherein said pump is located adjacent to said reservoir.

6. An automatic ice-making system for use with a bottled water supply comprising:

a. a refrigeration unit including a freezer section for receiving and freezing water, said freezer section including a sensor element for providing an output indicating a demand for additional water;

b. an enclosed reservoir for bottled water adjacent to said refrigeration unit;

c. a pump positioned adjacent to said reservoir and having a feed line extending into said reservoir and in communication with said pump; d. a solenoid valve having an input coupled to a water output of said pump and having an output coupled to said freezer section of said refrigeration unit;

e. a first circuit wire pair coupled between said pump and said solenoid valve, said first circuit wire pair including piggyback prong connectors at the juncture with said valve;

f. a second circuit wire pair coupled between said sensor element in said freezer section and said piggyback connectors of said first circuit pair; and wherein g. the sensing of a demand for additional water by said sensing element permits the simultaneous energizing of said pump and the opening of said valve, to permit water to be pumped from said container into said freezer unit.

7. An automatic ice-making system for use with a bottled water supply comprising:

(a) a refrigeration unit including a freezer section for receiving and freezing water, said freezer section including a sensor element for providing an output indicating a demand for additional water;

(b) an enclosed reservoir for bottled water adjacent to said refrigeration unit;

(c) a pump positioned adjacent to said reservoir and having a feed line extending into said reservoir and in communication with said pump;

(d) a solenoid valve having an input coupled to a water output of said pump and having an output coupled to said freezer section of said refrigeration unit;

(e) a first circuit wire pair coupled between said pump and said solenoid valve, said first circuit wire pair including connecting means at the juncture with said valve;

(f) a second circuit wire pair coupled between said sensor element in said freezer section and said connecting means of said first circuit pair; and wherein (g) the sensing of a demand for additional water by said sensing element permits the simultaneous energizing of said pump and the opening of said valve, to permit water to be pumped from said container into said freezer unit, and further wherein said sensor element includes means for terminating said output when said demand for water in said freezer section is met so as to simultaneously deenergize said pump and close said valve upon termination of said output.

* * * * *